United States Patent [19]

Weschenfelder et al.

[11] 4,231,559

[45] Nov. 4, 1980

[54] FOLDING JAW CYLINDER

[75] Inventors: Otto T. Weschenfelder, Wurzburg; Horst B. Michalik, Hochberg, both of Fed. Rep. of Germany

[73] Assignee: Koenig & Bauer Aktiengesellschaft, Wurzburg, Fed. Rep. of Germany

[21] Appl. No.: 949,184

[22] Filed: Oct. 6, 1978

[30] Foreign Application Priority Data

Oct. 8, 1977 [DE] Fed. Rep. of Germany ..... 2745359

[51] Int. Cl.[3] ..... B65H 45/16

[52] U.S. Cl. ..... 493/426; 493/432

[58] Field of Search ..... 270/70–75, 270/78, 63, 64

[56] References Cited

U.S. PATENT DOCUMENTS

| | | | |
|---|---|---|---|
| 2,435,881 | 2/1948 | Faeber | 270/72 |
| 2,891,791 | 6/1959 | Chase | 270/71 |
| 3,163,413 | 12/1964 | Franke | 270/73 |

FOREIGN PATENT DOCUMENTS

| | | | |
|---|---|---|---|
| 623219 | 11/1935 | Fed. Rep. of Germany | 270/71 |
| 1505567 | 12/1967 | France | 270/71 |

*Primary Examiner*—Edgar S. Burr
*Assistant Examiner*—A. Heinz
*Attorney, Agent, or Firm*—Jones, Tullar & Cooper

[57] ABSTRACT

A folding jaw cylinder having friction increasing elements for insuring that the fold is not withdrawn from the folding jaws during removal of the folding blade is disclosed. The folding jaw cylinder includes a fixed front folding edge and a movable folding jaw which together cooperate to form a folding slot into which a folding blade forces a plurality of sheets which are folded into a signature. The folding jaw carries suitable friction increasing elements and the folding slot is so structured that the folded sheets are retained in the slot while the folding blade is withdrawn.

5 Claims, 3 Drawing Figures

FOLDING JAW CYLINDER

FIELD OF THE INVENTION

The present invention is directed generally to a folding jaw cylinder for a folding mechanism in a web-fed rotary printing press. More particularly, the present invention is directed to a folding jaw assembly including frictional elements to retain the folded sheets in the folding slot. Most specifically, the present invention is directed to a folding jaw cylinder having a fixed folding edge and a movable folding jaw with the folding edge and jaw cooperating to define a folding slot. A portion of a collated stack of sheets is forced between the folding edge and jaw by a folding blade. A friction increasing element or structure is carried by the folding jaw and contacts the fold created in the collated sheets to retain the folded sheets within the folding slot during removal of the folding blade. One or a plurality of these folding jaws can be provided on the folding jaw cylinder.

DESCRIPTION OF THE PRIOR ART

Folding jaw cylinders for folding mechanisms and their controls are generally known in the art, as may be seen in U.S. Pat. No. 2,891,791. One problem with such folding jaw cylinders is that of retention of the folded sheets within the assembly while the folding blade is being removed. If the folding jaws engage the folded sheets with too great a force, the folding blade is difficult to remove. Too little force allows the folded sheets to be withdrawn by the folding blade.

One attempted solution may be seen in German Pat. No. 623219 which shows a specifically shaped folding jaw, the object of which is to make sure that the fold of the collated sheets folded into groups known as signatures is held in the folding slot while the folding blade is withdrawn. In this patent, however, in order to prevent jamming of the blade in the slot, the folding blade and the folding jaw are provided with rectangular teeth which produce an inaccurate and nonuniform fold. This shape of the blade and jaw may also produce stains and damage the product being folded.

SUMMARY OF THE INVENTION

It is an object of the present invention to provide a folding jaw cylinder for a rotary web-fed printing press.

Another object of the present invention is to provide a folding jaw cylinder having means for retaining the folded signatures in the folding slot.

Yet a further object of the present invention is to provide a folding jaw cylinder in which the folding blade may be withdrawn from the folding slot without causing withdrawal of the folded signature.

As will be discussed in greater detail in the detailed description of preferred embodiments, the folding jaw cylinder assembly in accordance with the present invention includes a cylinder having at least one fixed front folding edge and a movable folding jaw with the edge and jaw cooperating to define a folding slot into which a folding blade forces a portion of a collated stack of sheets to fold the sheets into a signature. The folding slot is provided with an interior, axially extending enlarged chamber and the folding jaw carries suitable friction increasing means so that the fold created by the folding blade will be retained in the folding slot after removal of the folding blade.

The folding jaw cylinder in accordance with the present invention provides an assembly in which the collated sheets folded into a signature are formed with a smooth, accurate fold. The folded portion itself is retained within the folding slot of the cylinder and is not pulled out of the slot when the folding blade is removed. The paper is not stained or strained by the folding blade and the folding is completed in a smooth, neat, efficient manner.

BRIEF DESCRIPTION OF THE DRAWINGS

While the novel features of the folding jaw cylinder in accordance with the present invention are set forth with particularity in the appended claims, a full and complete understanding of the invention may be had by referring to the detailed description of preferred embodiments as set forth hereinafter and as shown in the accompanying drawings in which:

DESCRIPTION OF PREFERRED EMBODIMENTS

Figure 1:
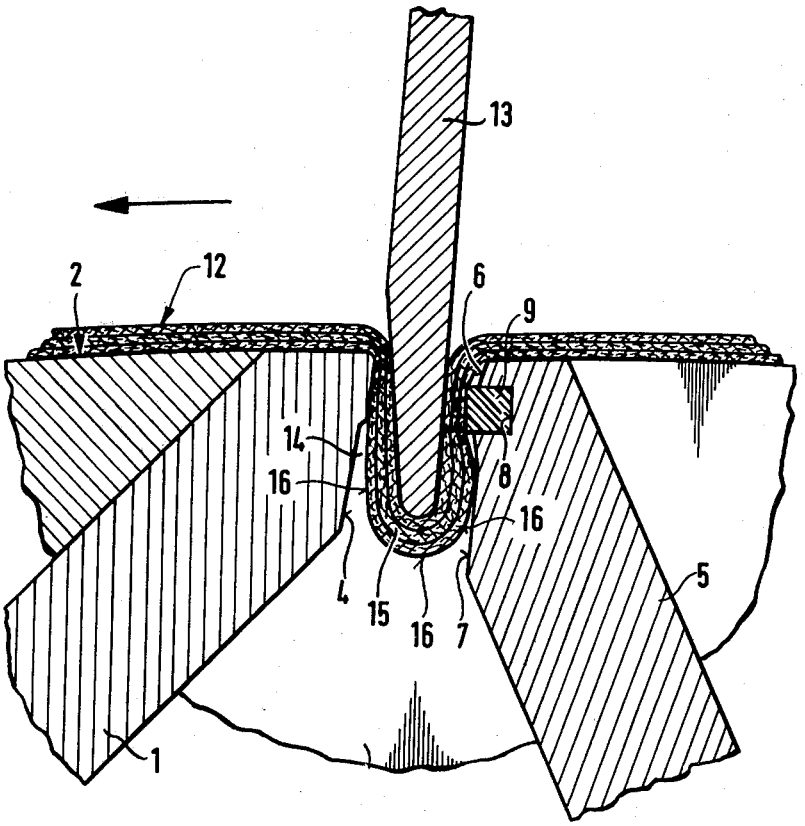
FIG. 1 is a schematic cross-sectional view of a portion of a first preferred embodiment of a folding jaw cylinder in accordance with the present invention.

Turning now to FIG. 1, there may be seen a first preferred embodiment of a folding jaw cylinder in accordance with the present invention. It will be understood that the folding jaw cylinder generally, its drive means and controls, and the like are conventional and are not shown. The folding jaw cylinder operates in a known manner to receive collated sheets produced by a web-fed rotary printing press and to fold these collated sheets into signatures which are then transferred away. This operation is generally known in the art and requires no further discussion.

As may be seen in FIG. 1, a folding jaw cylinder, generally at 2, is provided with a fixed front folding edge 1 which extends axially along the surface of cylinder 2. Edge 1 is equipped with an inner recess 4 and is firmly secured to cylinder 2. A cooperating folding jaw 5, which is capable of being moved and controlled in a known manner, is spaced from edge 1 and extends parallel to edge 1 axially along cylinder 2. Jaw 5 has a folding surface 6 which is adjacent the surface of cylinder 2 and extends radially inwardly toward the axis of cylinder 2. An inner recess 7 extends further inwardly from folding surface 6. The folding edge 1 and the folding jaw 5 cooperate to form a folding gap 3. The inner recesses 4 and 7 provide an enlarged inner space or folding slot 14 between the edge 1 and jaw 5.

A notch 8 is formed in the folding or gripping surface 6 of jaw 5 and extends parallel to the axis of rotation of folding jaw cylinder 2. A resilient rod 9 is positioned in notch 8 and is held in place by any suitable means. The resilient rod 9 projects outwardly into the folding slot 14 approximately 3 mm from folding surface 6. While rod 9 is shown in FIG. 1 as having a rectangular cross section, it will be apparent that this element could have any other suitable cross-sectional shape such as round, oval, or the like.

Figure 2:
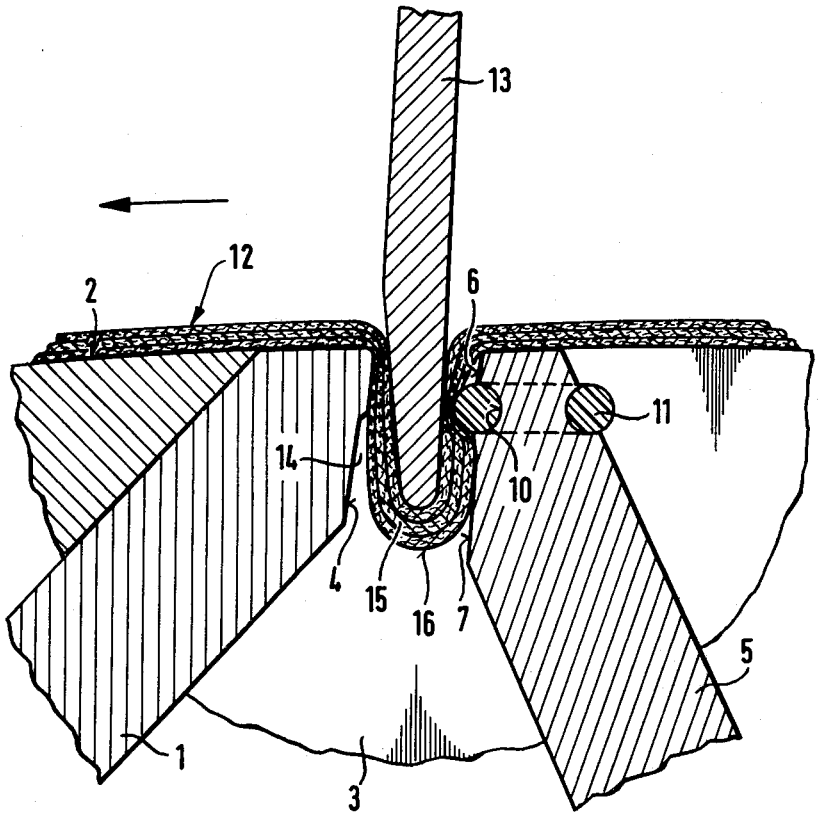
FIG. 2 is a schematic cross-sectional view of a second preferred embodiment of a folding jaw cylinder in accordance with the present invention.

In an alternate embodiment, as may be seen in FIG. 2, a commercially available O-ring 11 may be placed on folding jaw 5 which has been provided with a circular notch 10 instead of the rectangular notch 8 of FIG. 1. Jaw 5 could also include a similar notch on its rear surface to aid in the retention of O-ring 11 on jaw 5.

In the embodiments shown in FIGS. 1 and 2, the resilient material for rod 9 and O-ring 11 may be an elastomeric material such as neoprene or polyurethane, for example, having a hardness of between 50 and 90 shore and a coefficient of friction (paper/rubber) exceeding 0.18.

In operation, a collated stack of sheets 12 are pinned or otherwise secured to the surface 2 of the folding jaw cylinder by any suitable and conventional means. Initially folding jaw 5 is open and away from folding edge 1. In this position, a folding blade 13 enters the folding slot 14 between the inner recess 4 of edge 1 and the folding surface 6 and inner recess 7 of folding jaw 5 and presses a portion of the sheets 12 into the folding slot 14. As folding blade 13 reaches its innermost limit, a fold 15 is formed in the sheets 12 with a bulge portion 16 of sheets 12 extending downwardly into the inner recess formed by portions 4 and 7 of edge 1 and jaw 5, respectively. When the folding jaw 5 is closed, rod 9 or O-ring 11 presses the portion of fold 15 above bulge 16 against the folding blade 13. Movement of jaw 5 toward blade 13 compresses the resilient rod 9 or O-ring 11 so that when the blade 13 is removed from folding slot 14, the resilient material of rod 9 or O-ring 11 presses downwardly and outwardly to prevent the blade 13 from pulling the fold 15 out of the folding slot 14.

Figure 3:
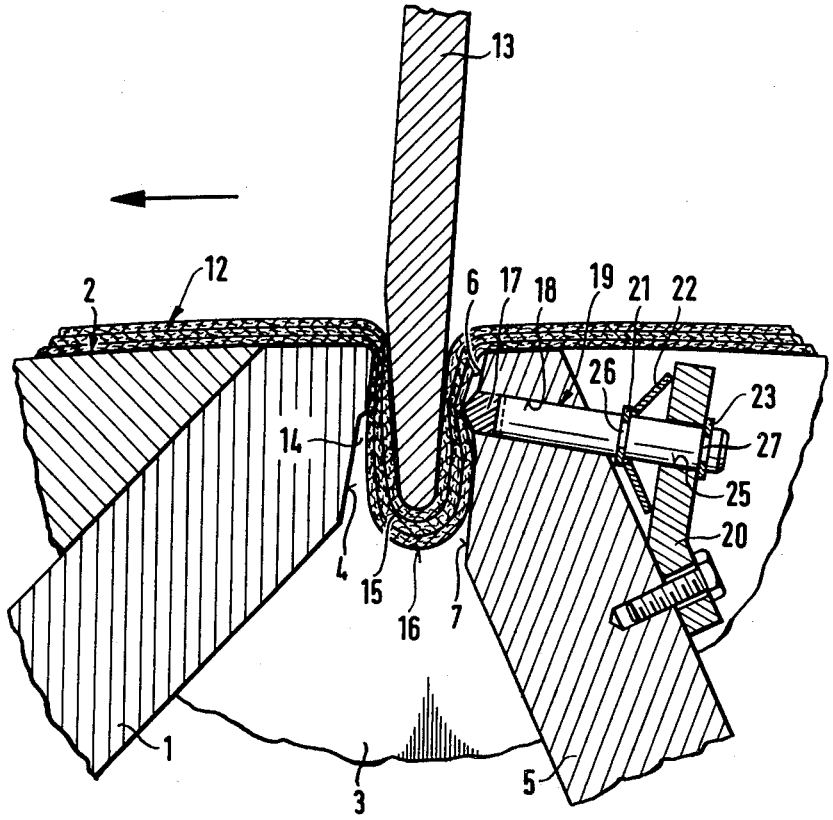
FIG. 3 is a schematic cross-sectional view of a third preferred embodiment of a folding jaw cylinder in accordance with the present invention.

A third embodiment of a folding jaw cylinder in accordance with the present invention may be seen in FIG. 3. In this embodiment, a resilient rod 17 is positioned in a notch 18 on folding jaw 5 and projects outwardly a distance of approximately 4 mm from the folding surface 6. Rod 17 is secured by any suitable means to a plurality of circular-shaped pins 19 which pass through apertures in jaw 5. An angled support bracket 20 has a first leg welded or otherwise secured to the surface of jaw 5 and a second leg portion of bracket 20 extends generally upwardly away from jaw 5. This second leg of bracket 20 is provided with spaced holes 25 which receive the free ends of pins 19. Annular grooves 26 and 27 are placed generally at the midpoint and at the free end of pins 19 with retaining ring clips 21 and 23 being carried in grooves 26 and 27, respectively. Ring clips 23 retain the pins in bracket 20 and clips 26 cooperate with cup springs 22 to bias the pins 19 and hence the resilient rod 17 into contact with the folded portion 15 of the collated sheets 12.

Operation of the embodiment shown in FIG. 3 is generally similar to that of the embodiments of FIGS. 1 and 2. When the folding jaw 5 is closed, the rod of resilient material 17 presses against the fold 15 and is thus pressed into, and received by, the notch 18. As the folding blade 13 is moved out of fold 15, the cup spring 22 presses the rod 17 out so that the fold 15 is retained in the folding slot 14 and is not pulled out by blade 13. The material used for rod 17 may be the same as that used for the other friction increasing elements; i.e., rod 9 an O-ring 11, or rod 17 may be less resilient and less compressible than rod 9 or O-ring 11 while still retaining a high coefficient of friction similar to the coefficients of friction of rod 9 and O-ring 11.

It will thus be seen that there has been hereinabove fully and completely described three preferred embodiments of a folding jaw cylinder in accordance with the present invention. The folding jaw cylinder of the present invention functions to retain the folded portion of a signature within the folding slot by the use of high friction elements which are carried by the folding jaw and which contact the fold itself. It will be obvious to one of ordinary skill in the art that numerous changes in, for example, the specific resilient material used, the number of folding jaws and blades for each cylinder, the drive means for the cylinder, the specific shapes of the resilient elements, and the like could be made without departing from the true spirit and scope of the invention and that the invention is to be limited only by the following claims.

We claim:

1. A folding jaw cylinder for a folding mechanism in a web-fed rotary printing machine, said folding jaw cylinder including a fixed front folding edge extending axially along a surface portion of said cylinder and having a first recess and a spaced, cooperating movable folding jaw, said folding jaw having a folding surface adjacent the surface of said cylinder and extending radially inwardly toward the center of said cylinder and having a second inner recess, said folding edge and folding jaw cooperating to form a folding gap with said first and second inner recesses cooperating to form a folding slot into which a portion of a collated stack of sheets may be forced by a folding blade to form a fold in said sheets, said fold in said sheets having a bulge portion extending into said folding slot, said folding jaw being movable toward said folding edge to contact said fold after said fold has been formed, said folding blade remaining in said fold during said movement of said folding jaw toward said folding edge, said folding jaw having a resilient friction increasing means having a coefficient of friction exceeding 0.18, said resilient friction increasing means projecting out of a notch in said folding surface and extending into said folding gap from said folding surface to press against said fold in said sheets radially outwardly from said bulge portion of said fold in said folding slot whereby said fold will be retained in said folding slot as said folding blade is moved out of contact with said sheets.

2. The folding jaw cylinder of claim 1 wherein said friction increasing means is a resilient rod positioned in said notch in said folding surface, said notch extending generally parallel to an axis of rotation of said folding jaw cylinder.

3. The folding jaw cylinder of claim 2 wherein said friction increasing means is secured to a plurality of spring biased pins extending through said folding surface.

4. The folding jaw cylinder of claim 1 wherein said friction increasing means is resilient O-ring positioned in said notch in said folding surface, said ring extending along said folding jaw generally parallel to an axis of rotation of said folding jaw cylinder.

5. The folding jaw cylinder of claim 1 in which said friction increasing means has a hardness of between 50 and 90 shore.

* * * * *